US006789365B1

(12) United States Patent
Hohmann et al.

(10) Patent No.: US 6,789,365 B1
(45) Date of Patent: Sep. 14, 2004

(54) SIDE-WELDED ANCHORS AND REINFORCEMENTS FOR MASONRY WALLS

(75) Inventors: Ronald P. Hohmann, Hauppauge, NY (US); Ronald P Hohmann, Jr., Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 44 days.

(21) Appl. No.: 10/293,808

(22) Filed: Nov. 13, 2002

(51) Int. Cl.[7] ..... E04B 1/02

(52) U.S. Cl. ..... 52/565; 52/713; 52/508; 52/309.11

(58) Field of Search ..... 52/309.8, 309.11, 52/508, 513, 565, 713, 714, 509, 699

(56) References Cited

U.S. PATENT DOCUMENTS

| | | | | |
|---|---|---|---|---|
| 3,377,764 | A | 4/1968 | Storch | |
| 4,021,990 | A | 5/1977 | Schwalberg | |
| 4,373,314 | A | 2/1983 | Allan | |
| 4,473,984 | A | 10/1984 | Lopez | |
| 4,869,038 | A | 9/1989 | Catani | |
| 4,875,319 | A | 10/1989 | Hohmann | |
| 5,392,581 | A | 2/1995 | Hatzinikolas et al. | |
| 5,408,798 | A | 4/1995 | Hohmann | |
| 5,454,200 | A | * 10/1995 | Hohmann | 52/513 |
| 5,456,052 | A | 10/1995 | Anderson et al. | |
| 5,816,008 | A | 10/1998 | Hohmann | |
| 6,209,281 | B1 | 4/2001 | Rice | |
| 6,279,283 | B1 | * 8/2001 | Hohmann et al. | 52/379 |
| 6,668,505 | B1 | * 12/2003 | Hohmann et al. | 52/565 |

OTHER PUBLICATIONS

Building Envelope Requirements, 780 CMR§1304.0 et seq. of Chapter 13; Boston, MA, Jan. 1, 2001.

Cantini, Mario J.; Heavy Duty Joint Reinforcement, *Masonry*, Apr. 1995.

Lochonic, K. et al; Wall Reinforcing Design, *The Story Pole*, Aug. 2001.

Dur–O–Wal, Inc., Product Catalog (Aurora, Il; 2000).

Wire Bond Corp.; Product Catalog (Charlotte, NC; 2002/2003).

Hohmann & Barnard, Inc.; Product Catalog (Hauppauge, NY; 2002).

ASTM Standard Specification for Masonry Joint Reinforcement; Designation A 951–00 (Approved Sep. 10, 2000; Published Oct., 2000).

Duro–Wal Product Information Sheet, entitled I.L.E. Ladur–Eye (Aurora, Il—undated).

Wire Bond, Product Information, entitled Wire Bond's New Level Eye Adjustable System (Charlotte, NC; 2002).

Fero Holdings Ltd.; Product Catalog and data sheets (Edmont, Alberta, Canada; undated).

* cited by examiner

*Primary Examiner*—Carl D. Friedman
*Assistant Examiner*—Naoko Slack
(74) *Attorney, Agent, or Firm*—Ronald P. Hohmann; Ronald P. Hohmann, Jr.

(57) ABSTRACT

Side-welded anchor and reinforcement devices for a cavity wall are disclosed. The devices are combined with interlocking veneer anchors, and with veneer reinforcements to form unique anchoring systems. The components of each system are structured from reinforcing wire and wire formatives, including as part thereof truss or ladder mesh reinforcements, and provide wire-to-wire connections therebetween. Beyond the portions of the wire formatives inserted in the backup wall, the wire formatives are reduced in height by cold-working thereof. The combined side-welded wall anchor and reinforcement devices are compressively reduced in height for spanning insulation mounted on the exterior of the backup wall. The low-profile portions are disposed between thick strips of insulation and maintain integrity thereof by preventing air leakage.

15 Claims, 7 Drawing Sheets

SIDE-WELDED ANCHORS AND REINFORCEMENTS FOR MASONRY WALLS

RELATED APPLICATIONS

This Application is related to an Application entitled High-Span Anchoring Systems for Cavity Walls, Ser. No. 10/188,536, filed Jul. 3, 2002, and is a continuation-in-part of an Application entitled High-Span Anchors and Reinforcements for Masonry Walls, Ser. No. 10/233,791, filed Sep. 3, 2002.

BACKGROUND OF THE INVENTION

1. Field of the Invention

This invention relates to anchors that are side welded to reinforcements for masonry backup walls, and, in particular, to those cavity wall constructs requiring superior anchoring properties and low-profile anchor configurations. While the wall anchor/wall reinforcement combination as described in the parent application is especially adapted for high-span applications, the resistance-welded, wire formative technology hereof is applicable to other cavity wall systems wherein the meeting of wind shear and seismic specifications has been heretofore problematic.

2. Description of the Prior Act

In recent developments of low-profile and high-span anchoring devices, several metalworking techniques that had not previously been utilized, were employed with significant and gratifying results. Some of these developments arose in response to shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜ inch-high space in the inner wythe and tie down a veneer facing material of an outer wythe at a span of two or more times that which had previously been experienced.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enables the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block.

In the past, there have been investigations relating to the effects of various forces, particularly lateral forces, upon brick veneer construction having wire formative anchors embedded in the mortar joint of anchored veneer walls. The seismic aspect of these investigations were referenced in the first-named inventor's prior patents, namely, U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions. The first-named inventor's related Seismiclip$^R$ and DW-10-X$^R$ products (manufactured by Hohmann & Barnard, Inc., Hauppauge, N.Y. 11788) have become widely accepted in the industry. The use of a wire formative anchors and reinforcement wire structures in masonry walls has been shown to be protective against problems arising from thermal expansion and contraction. Also, such structures have improved the uniformity of the distribution of lateral forces. However, these past investigations do not address the mortar layer thickness vs. the wire diameter of the wire formative or the technical problems arising therefrom.

Over time and as the industry matured, besides the Uniform Building Code other standards came into existence, including the promulgation by the ASTM Committee A01 on Steel of the Standard Specifications for Masonry Joint Reinforcement, A951-00 (hereinafter A951). The Standard sets forth that masonry joint reinforcement is to be assembled by automatic machines to assure accurate spacing and alignment of all members of the finished product and that longitudinal and cross wires are to be securely connected at every intersection by an electric-resistance welding process that includes fusion welding together with applied pressure to join the materials. The Standard further sets forth details as to the exterior of the longitudinal wires and the mechanical requirements of the overall construct.

According to the ASTM Committee A01, joint reinforcement has been used in the masonry industry since 1940. In introducing A951, the Committee states:

For most of the period since then, its manufacture has been limited to a relatively small group of producers and users who simply referred to "manufacturers' recommendations" as the standard of quality and acceptance. With the adoption of a new consensus standard for the design of masonry, it became clear that a standard for the manufacture of joint reinforcement was needed. In developing this standard it was decided to use a format similar to that used for the ASTM Standard for Welded Wire Fabric, Plain, for Concrete Reinforcement, Specification A185, since many people had the notion that joint reinforcement was used in a manner similar to wire mesh. A significant difference between wire mesh and joint reinforcement arose when an attempt was made to fashion the requirements for weld shear strength after those in Specification A185.

The Committee found that almost all of the manufacturers of joint reinforcement use butt welds so that the total thickness of material at a weld is as small as possible. This is important since, in conventional mortar bed joints, there is not much room to install joint reinforcement. In addition, it found that in masonry joint reinforcement the majority of product produced is that with a "truss" configuration in which the angle of intersection varies for each different width of product produced since the pitch between welds is a constant 16 inches. These characteristics differentiated the testing for weld shear strength from those of Specification A185 and resulted in the development of a distinct test methodology.

In the course of preparing this disclosure several patents became known to the inventors hereof. The following patents are believed to be relevant and are discussed further as to the significance thereof:

| Patent | Inventor | Issue Date |
|---|---|---|
| 3,377,764 | Storch | 04/16/1968 |
| 4,021,990 | Schwalberg | 05/10/1977 |
| 4,373,314 | Allan | 02/15/1983 |
| 4,473,984 | Lopez | 10/02/1984 |
| 4,869,038 | Catani | 09/26/1989 |
| 4,875,319 | Hohmann | 10/24/1989 |
| 5,392,581 | Hatzinikolas et al. | 02/28/1995 |
| 5,408,798 | Hohmann | 04/25/1995 |
| 5,456,052 | Anderson et al. | 10/10/1995 |
| 5,816,008 | Hohmann | 10/15/1998 |
| 6,209,281 | Rice | 04/03/2001 |
| 6,279,283 | Hohmann et al. | 08/28/2001 |

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued Sep. 26, 1989 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Sep. 24, 1989 Discloses a seismic construction system for anchoring a facing veneer to wallboard/metal stud construction with a pronged sheet-metal anchor. Wall tie is distinguished over that of Schwalberg '990 and is clipped onto a straight wire run.

U.S. Pat. No. 5,392,581—Hatzinikolas et al.—Issued Feb. 28, 1995 Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheet-metal and are arranged on substantially the same horizontal plane.

U.S. Pat. No. 5,816,008—Hohmann—Issued Oct. 15, 1998 Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

None of the above provide the combined side-welded wall anchor and wall reinforcement devices or the anchoring systems utilizing these devices. As will become clear in reviewing the disclosure which follows, the masonry backup walls benefit from the recent developments described above that led first to solving the problems of high-spans and later to some ways of providing low profile devices. In the related Application, wire formatives are compressively reduced in height at the junctures between the wall reinforcements and the wall anchors. This enabled the stacked components to be inserted within the bed joints and still have a covering of mortar. While this approach worked well, alternatives utilizing techniques such as side-welding and fusing under heat and pressure are presented hereinbelow.

SUMMARY

In general terms, the invention disclosed hereby includes side-welded anchor and reinforcement device for a cavity wall, which devices are combined with interlocking veneer anchors, and in one embodiment hereof with veneer reinforcements. The wall construct has an inner wythe or backup wall and an outer wythe or facing wall. The wythes are in a spaced apart relationship have a cavity therebetween. In the embodiments disclosed, a unique combination of a wall anchor, a reinforcement and a veneer anchor is provided.

The invention contemplates that the primary components of the system are structured from reinforcing wire and wire formatives, including as part of the combined device, truss reinforcement or ladder mesh reinforcements, and provide wire-to-wire connections therebetween. Further, in two embodiments combine wire formatives which are selectively and compressively reduced in height by the cold-working thereof.

The embodiments of the invention disclosed hereby include anchoring systems with side-welded wall anchors and low-profile veneer anchors for use in the construction of a wall having an inner wythe with thick strips of insulation attached thereto. Where as in the first embodiment, there is compressive reduction in height of the insulation-spanning leg portions, the air leakage at and adjacent heavy wire components is substantially overcome. This results as the strips of insulation are installed so that the seams between the strips are coplanar with the inner wythe bed joints. The insulation-spanning legs of the wall anchors protrude into the cavity through the seams, which seams seal thereabout so as to maintain the integrity of the insulation and minimize air leakage along the wall anchors. The invention contemplates that some components of the system are as described in U.S. Pat. Nos. 5,408,798; 5,454,200; and 6,279,283 and that the wire formatives hereof provide a positive interlocking connection therebetween specific for the requirements created by this side-welded anchor and anchoring system application.

In the mode of practicing the invention, wherein the inner wythe is constructed from a masonry block material, the masonry anchor has, for example, a truss portion with eye wire extensions welded thereto. The eye wires extend across the insulation into the cavity between the wythes. Each of the eye wires accommodates the threading thereinto of a wire facing anchor or wall tie with either a pintle leg inserted through the eye or the open end of the wall tie. The wall tie is then positioned so that the insertion end is embedded in the facing wall. The masonry anchor is embedded in a bed joint of the interior wythe. Wall and veneer ties compressively reduced in height are described as being mounted in bed joints of the inner and outer wythes. The close control of overall heights permits the mortar of the bed joints to flow over and about the wall reinforcement and wall anchor combination inserted in the inner wythe and insertion end of the veneer anchor in the outer wythe.

OBJECTS AND FEATURES OF THE INVENTION

It is an object of the present invention to provide for cavity walls, anchoring systems, anchors for the masonry badkup walls, and anchors for the securement of facing veneers.

It is another object of the present invention to provide labor-saving, anchoring systems which employ resistance welded, wire formatives in the mortar joint of the inner wythe and is adapted to be positively interconnected with a veneer anchor inserted into the outer wythe.

It is yet another object of the present invention to provide a high-strength, anchoring systems for both insulated and uninsulated cavity wall structures which utilize high cross-sectional area components for wall reinforcement of the inner wythe in a manner such that the mortar layer coverage thereof is maintainable.

It is a further object of the present invention to provide an anchoring system comprising a limited number of component parts that are economical of manufacture resulting in a low unit cost.

It is yet another object of the present invention to provide an anchoring system which is easy to install and which meets seismic and shear resistance requirements.

It is a feature of the present invention that the portion of the wall anchor embedded in the bed joint of the inner wythe is fused during resistance welding thereof to the wire reinforcement portion.

It is another feature of the present invention that the veneer anchor, the wall tie and the combined wall anchor and wall reinforcement are dimensioned so that, when inserted into the respective mortar layers, the mortar thereof can flow around the wall-anchor-to-reinforcement-wire joint.

It is yet another feature of the present invention that the reinforcement wire of the inner wythe is combinable with a low-profile wall anchor to span the insulation of the cavity wall at the seam thereof and that the wall anchor is sealingly surrounded by the insulation.

Other objects and features of the invention will become apparent upon review of the drawing and the detailed description which follows.

BRIEF DESCRIPTION OF THE DRAWING

In the following drawings, the same parts in the various views are afforded the same reference designators.

DESCRIPTION OF THE PREFERRED EMBODIMENTS

Figure 1:
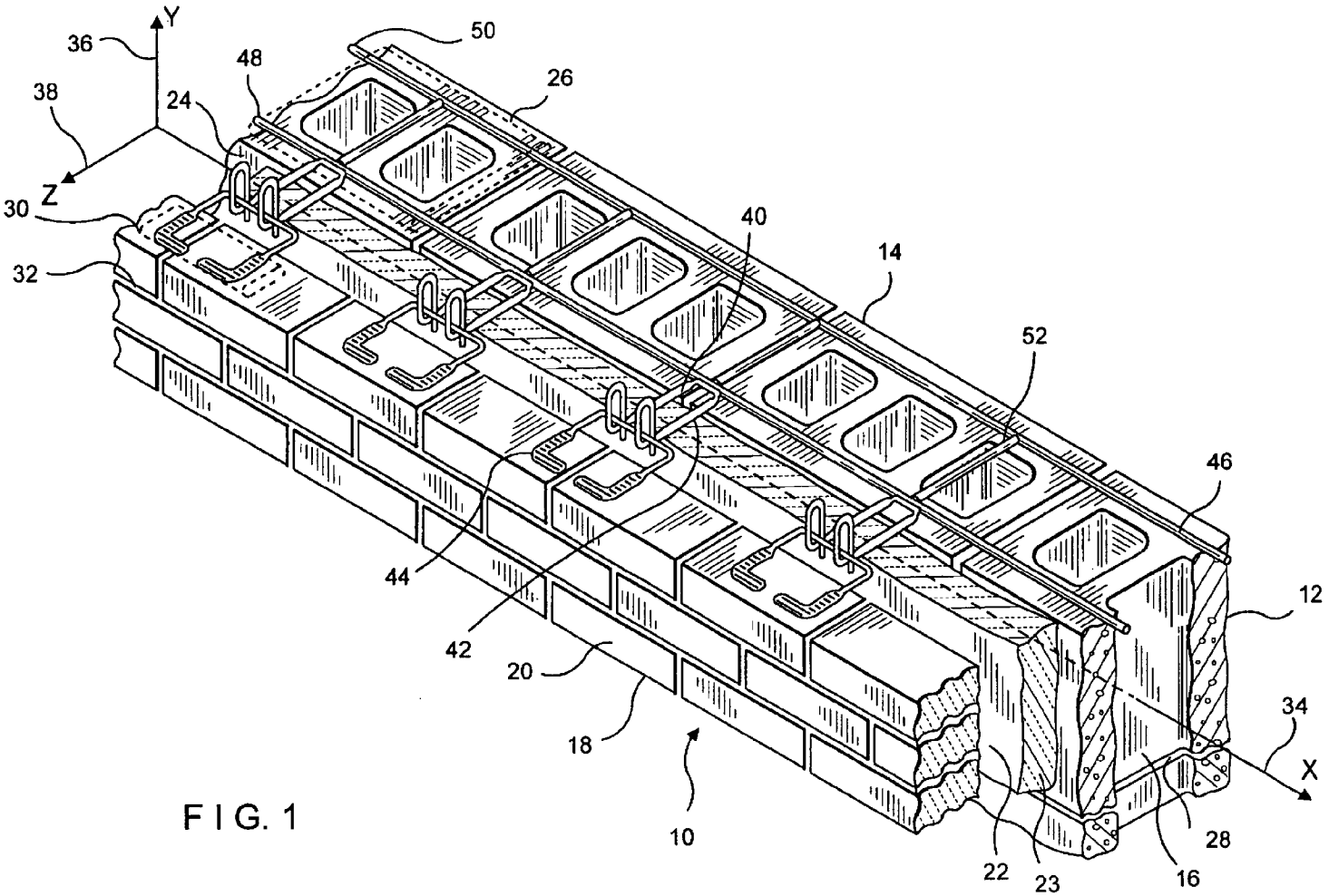
FIG. 1 is a perspective view of a first embodiment of this invention showing a side-welded anchor and reinforcement device for a cavity wall, a cavity with insulation mounted as the backup wall, and a brick veneer facing.

Before entering into the detailed Description of the Preferred Embodiments, several terms are defined, which terms will be revisited later, when some relevant analytical issues are discussed. When stronger joint reinforcements are required in the inner wythe or backup wall to support the stresses imparted by anchoring the outer wythe or veneer. As described hereinbelow, this is accomplished while still maintaining building code requirements for masonry structures, including the mortar bed joint height specification—most commonly 0.375 inches. Although thicker gage wire formatives are used when required for greater strength, it is still desirable to have the bed joint mortar cover the wall anchor structure. Thus, the wall reinforcements are usually structured from 0.148 or 0.187 inch wire, and, in practical terms, the wire formatives hereof that are inserted into the bed joints of the inner and outer wythes have a height limited to approximately 0.187 inch.

In the detailed description, the wall reinforcements, the wall anchors, and the veneer anchors are wire formatives. The wire used in the fabrication of masonry joint reinforcement conforms to the requirements of ASTM Standard Specification A951-00, Table 1 For the purpose of this application weld shear strength tests, tensile strength tests and yield tests of masonry joint reinforcements are, where applicable, those denominated in ASTM A-951-00 Standard Specification for Masonry Joint Reinforcement. In the descriptions of wall anchors which follow, the wall anchors are butt or electric resistance welded to the ladder-type or the truss-type reinforcements. As the attachment methodology follows that of fabricating the Masonry Joint Reinforcements, the tests for the wall anchors, except where fixturing is dictated by configuration, follow the A-951 procedures.

In the detailed description of the anchoring systems hereof the various wall anchor embodiments have elements which receive interlocking or interengaging portions of the veneer anchor. These veneer anchor receptors are wire-formatives, such as double loops vertically disposed in the cavity for receiving box ties; eye wires—round eyelets horizontally disposed in the cavity for receiving pintle legs; and T-head openings—horizontally disposed in the cavity for receiving pintle legs or bent box ties. The veneer anchors, when extra reinforcement is desired, are configured to cradle, nest or interweave with wire reinforcements, which reinforcements are embedded in the bed joints of the veneer. The veneer reinforcements meet seismic specifications.

Another term defined for purposes of this application is wall reinforcement. A wall reinforcement is a continuous length of Lox All® Truss Mesh or Lox All® Ladder Mesh manufactured by Hohmann & Barnard, Inc., Hauppauge, N.Y. 11788 or equivalent adapted for embedment into the horizontal mortar joints of masonry walls. The wall reinforcements are prefabricated from cold-drawn steel wire and have parallel side rods with butt welded cross rods or truss components. The wall reinforcements for anchoring systems are generally structured from wire that is at least 0.148 and 0.187 inch in diameter.

Referring now to FIGS. 1 through 4, the first embodiment of a side-welded anchor and reinforcement for masonry backup wall is now discussed in detail. For the first embodiment, a cavity wall having an insulative layer of 1.5 inches (approx.) and a total span of 3 inches (approx.) is chosen as exemplary. The side-welded anchor and reinforcement device for masonry walls is referred to generally by the numeral 10. A cavity wall structure 12 is shown having an inner wythe or backup wall 14 of masonry blocks 16 and an outer wythe or facing wall 18 of brick 20. Between the inner wythe 14 and the outer wythe 18, a cavity 22 is formed.

The cavity 22 is insulated with strips of insulation 23 attached to the exterior surface 24 of the inner wythe 14 and having seams 25 between adjacent strips 23 coplanar with adjacent bed joints 26 and 28. The cavity 22 has a 3-inch span. Successive bed joints 26 and 28 are formed between courses of blocks 16. The bed joints 26 and 28 are substantially planar and horizontally disposed and in accord with building standards are 0.375-inch (approx.) in height. Also, successive bed joints 30 and 32 are formed between courses of bricks 20 and the joints are substantially planar and horizontally disposed. Selected bed joint 26 and bed joint 30 are constructed to be interconnected utilizing the construct hereof; however, in this embodiment, the joints 26 and 30 are unaligned.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A wall anchor 40 is shown which has an insulation-spanning-portion 42. Wall anchor 40 is a wire formative tie which is constructed for embedment in bed joint 26 and for interconnection with veneer tie 44.

The wall anchor 40 is adapted from one shown and described in Hohmann, U.S. Pat. No. 5,454,200, which patent is incorporated herein by reference. The wall anchor 40 is shown in FIG. 1 as being emplaced on a course of blocks 16 in preparation for embedment in the mortar of bed joint 26. In this embodiment, the system includes a ladder-type wall reinforcement 46, a wall anchor 40 and a veneer anchor 44. The wall reinforcement 46 is constructed of a wire formative with two parallel continuous straight, side wires 48 and 50 spaced so as, upon installation, to each be centered along the outer walls of the masonry blocks 16. An intermediate wire body or a plurality of cross rods 52 are interposed therebetween and connect wire members 48 and 50 forming rung-like portions of the ladder-type reinforcement 46. The horizontal xz-plane tangential to the upper limit of wires 48 and 50, the parallel xz-plane tangential to the lower limit, and the vertical xy-plane that includes surface 24 form an envelope within which the attachment end of wall anchor 40 is disposed.

At intervals along the ladder-type reinforcement 46, spaced pairs of transverse wire members 54 are attached thereto and are attached to each other by a rear leg 56 therebetween. These pairs of wire members 54 extend into the cavity 22. The spacing therebetween limits the x-axis movement of the construct. Each transverse wire member 54 has at the end opposite the attachment end, an eye wire portion 58 formed continuous therewith. Upon installation, the eye 60 of eye wire portion 58 is constructed to be within a substantially vertical plane normal to exterior surface 24. The eye 60 is elongated vertically to accept a veneer tie threadedly therethrough from the unaligned bed joint. The eye 60 is slightly larger horizontally than the diameter of the tie. This dimensional relationship minimizes the z-axis movement of the construct. For positive interengagement, the eye 60 of eye wire portion 58 is sealed forming a closed loop.

Figure 2:
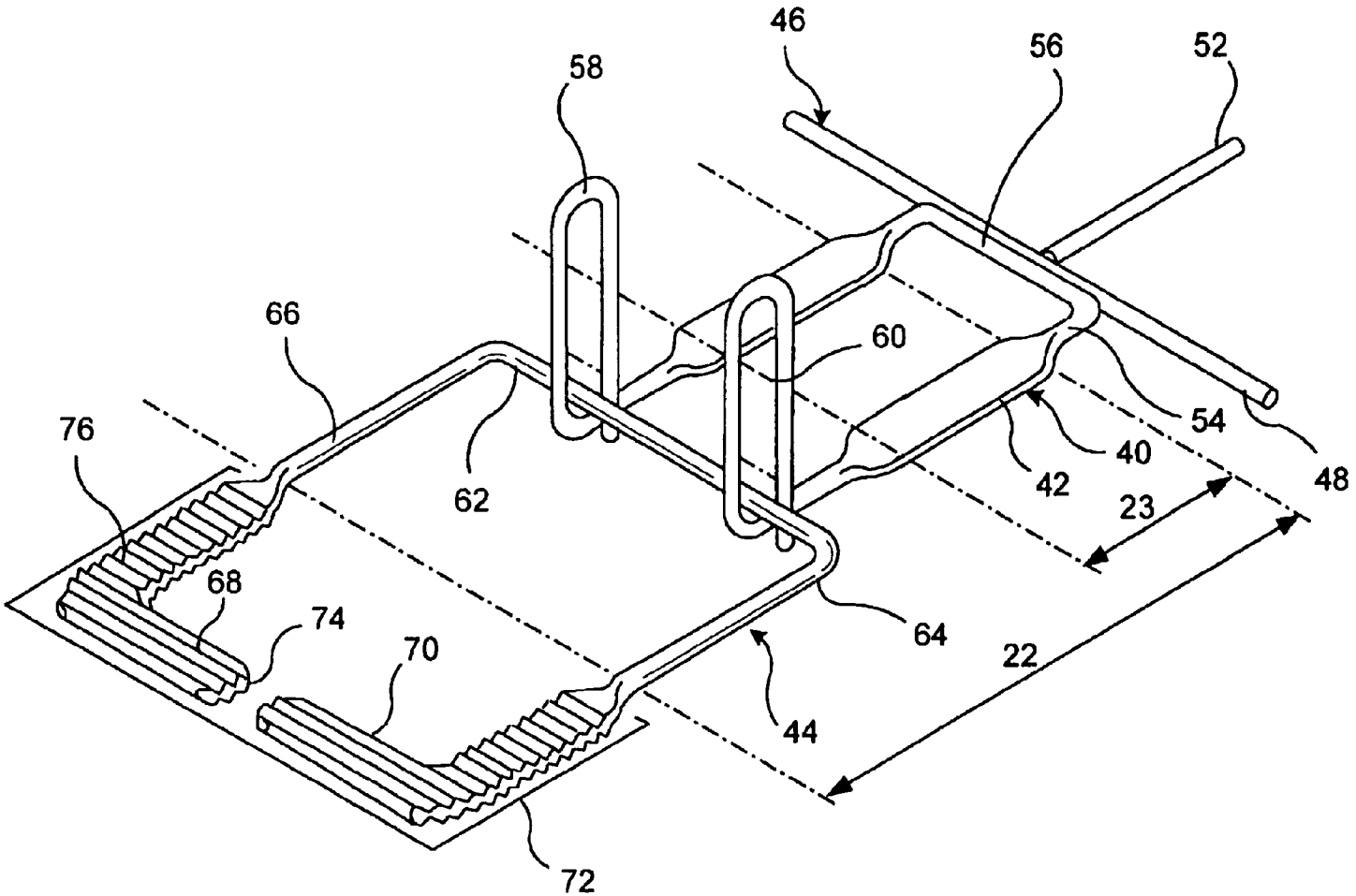
FIG. 2 is a partial perspective view of FIG. 1 showing a portion of the wall reinforcement; the resistance-welded, wall anchor; and, the interlocking veneer anchor.

The veneer tie or anchor 44, FIG. 2, is, when viewed from a top or bottom elevation, generally rectangular in shape and is a basically planar body. The veneer anchor 44 is dimensioned to be accommodated by a pair of eye wire portions 58 described, supra. The veneer anchor 44 has a rear leg portion 62, two parallel side leg portions 64 and 66, which are contiguous and attached to the rear leg portion 62 at one end thereof, and two parallel front leg portions 68 and 70.

To facilitate installation, the front leg portions 68 and 70 are spaced apart at least by the diameter of the eye wire member 58. The longitudinal axes of leg portions 66 and 68 and the longitudinal axes of the contiguous portions of the side leg portions 64 and 66 are substantially coplanar. The side leg portions 64 are structured to function cooperatively with the spacing of transverse wire members 54 to limit the x-axis movement of the construct. The box-shaped veneer anchor 44 and the double loops of the wall anchor 40 are constructed so that with insertion of the veneer anchor through eye 60, the misalignment between bed joints tolerated is approximately one-half the vertical spacing between adjacent bed joints of the facing brick course. As will be described in more detail hereinbelow, the insertion portion 72 of veneer tie 44 is considerably compressed with the vertical height 74 being reduced. Upon compression, a pattern or corrugation 76 is impressed.

For specific applications, the above-described arrangement of wire formatives has been strengthened in several ways. First, in place of the standard 9-gage (0.148-inch diameter) wall reinforcement wire, a 3/16-inch (0.187-inch diameter) wire is used. Additionally a 0.187-inch wire is used to form both the wall anchor 40 and the veneer anchor 44. For added strength, it is optional to employ 0.250-inch cross rods compressively reduced in height to fit within the envelope, see supra, and also U.S. Pat. No. 6,279,283 to Hohmann, et al. The insertion end of veneer anchor 44. is also compressively reduced in height and, although 0.187 wire is used, optionally a 0.250 wire reduced to a height of 0.150 is within the contemplation hereof. Additionally, extended leg 42 for spanning insulation 23 is reduced in height to improve sealing. Thus, the components hereof are selectively compressible, and, as a general rule, compressive reductions up to 75% are utilized. The tensile and shear strength calculations are based thereon.

In this embodiment, the rear leg portion 56 is secured to wire member 48 of ladder-type wall reinforcement 46 by resistance welding forming a butt weld. At the butt weld site, the metal bodies of the two members 56 and 48 are fused together which fusion is shown in the cutaway portion of FIG. 3. In order to fall within the height requirement, the insertion portion of the wall anchor 40, that is the portion thereof which is within the mortar of the bed joint lies wholly in-the envelope formed by the parallel planes of the upper and lower surfaces of the installed wall reinforcement 46 and the vertical plane of exterior surface 24.

Figure 3:
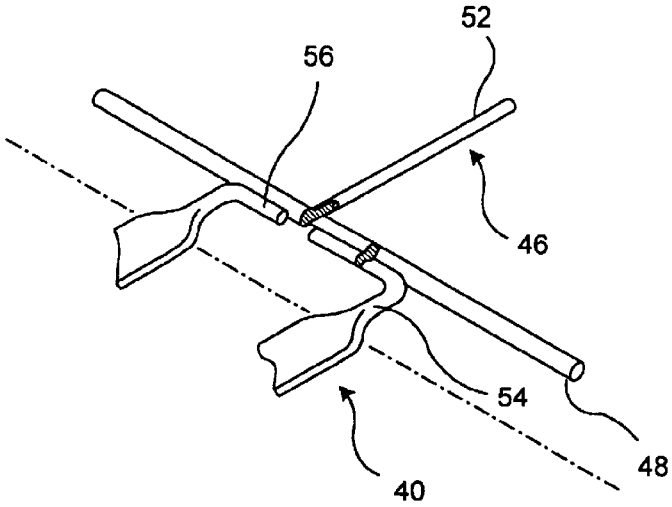
FIG. 3 is a partial perspective view of FIG. 2 which is cutaway to show the fusion of the back leg of the wall anchor and the masonry wall reinforcement at the weldment site.

As described in a prior patent of the present inventors, namely, Hohmann et al., U.S. Pat. No. 6,279,283, the insertion ends of the wall anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 1 and 2 and are impressed so that, upon installation, the corrugations are parallel to the x-axis. In FIG. 3, the lower surface of wall reinforcement 46 is shown having corrugations 80 impressed therein.

Figure 4:
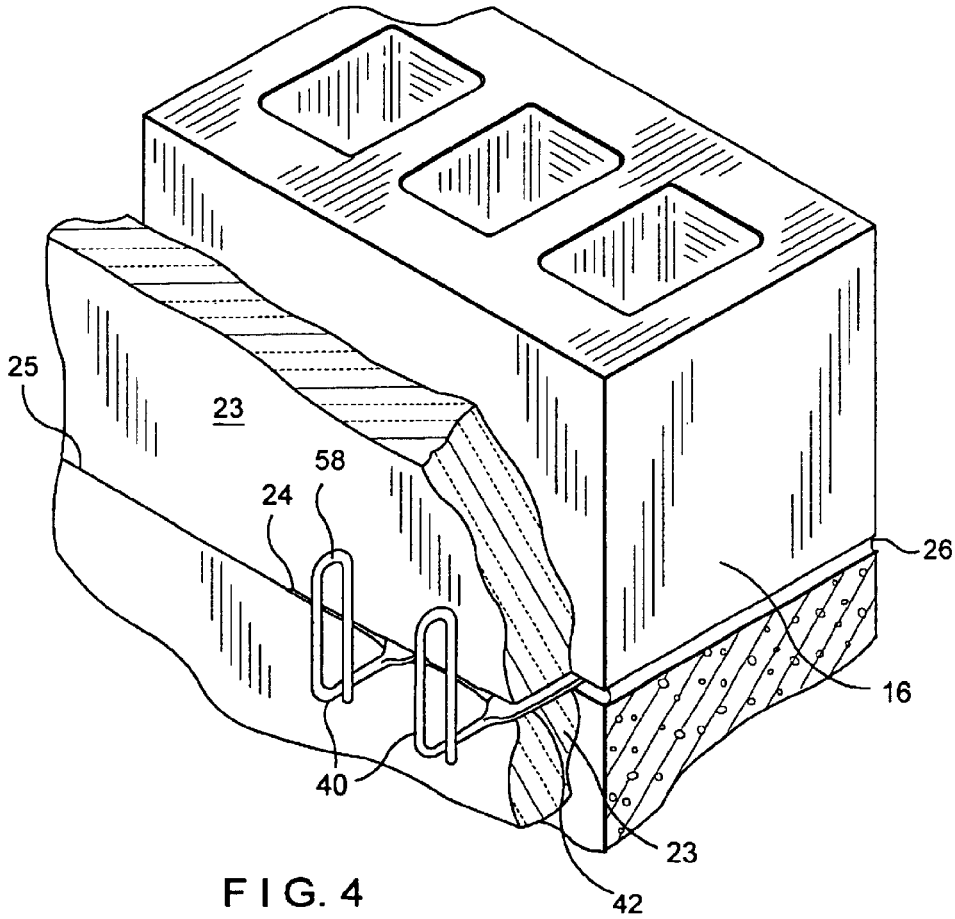
FIG. 4 is a partial perspective view of the insulation sealing about and against the insulation-spanning portion of the wall anchor of FIG. 2.

The wall cavity is insulated as required with a high R-factor insulation layer 23 as shown in FIG. 4. The, successive insulation strips 23 when in an abutting relationship the one with the other are sufficiently resilient to seal at seam 25 without air leakage therebetween. The insulation-spanning portions 42 of wall anchor 40 are flattened. This results in minimal interference with seal at seam 25.

Figure 5:
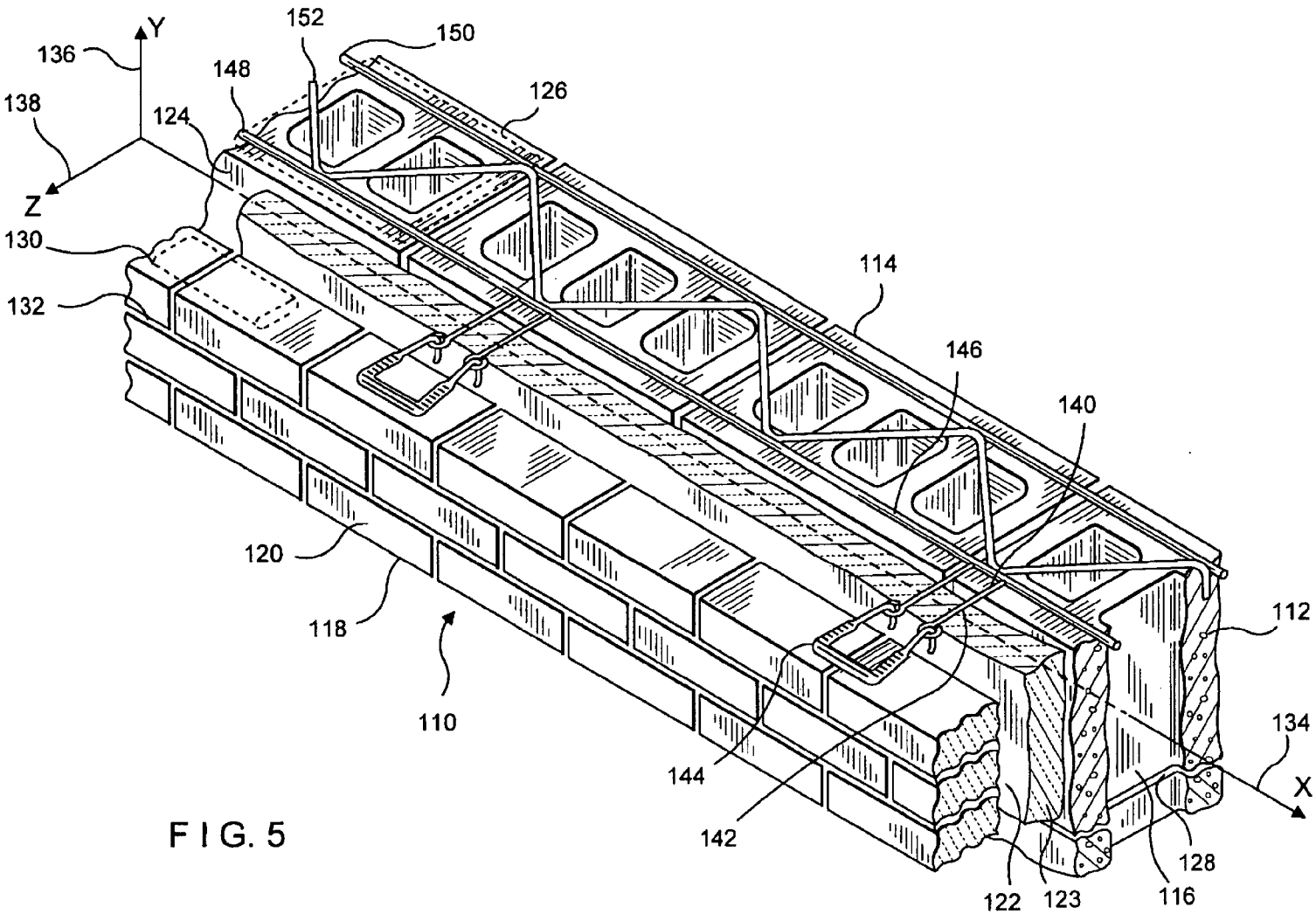
FIG. 5 is a perspective view of a second embodiment of this invention showing an anchor and reinforcement device for a masonry wall and is similar to FIG. 1, but shows a truss-mesh reinforcement in the backup wall, a wall anchor with horizontal eyelets, and a rectangular pintle veneer anchor in the facing wall.
Figure 6:
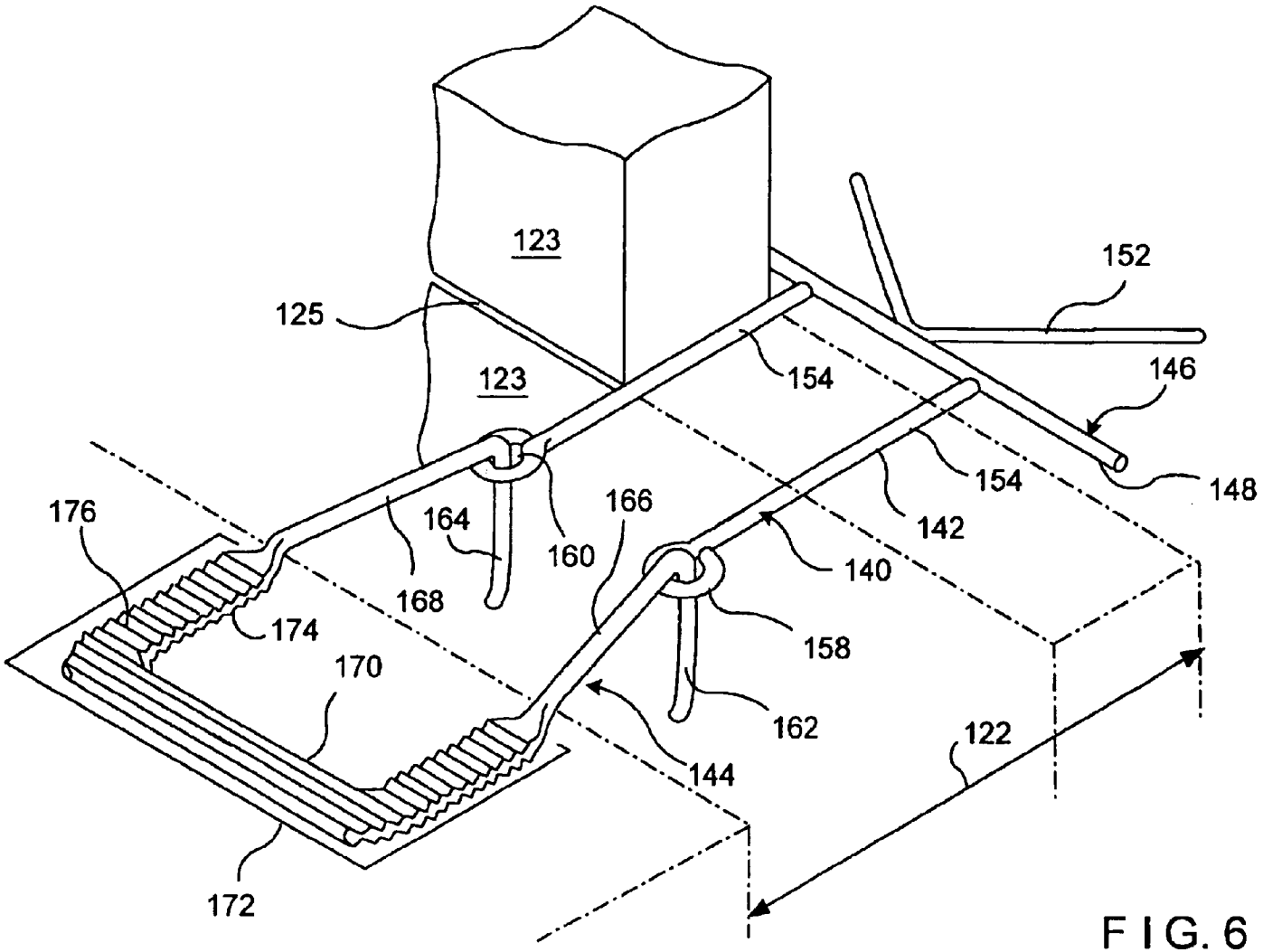
FIG. 6 is a partial perspective view of FIG. 5 showing a portion of the truss, a wall anchor and the interengaging veneer anchor.

The description which follows is of a second embodiment of the combined wall anchor and wall reinforcement device for masonry walls of this invention. For ease of comprehension, where similar parts are used reference designators "100" units higher are employed. Thus, the veneer anchor 144 of the second embodiment is analogous to the veneer anchor 44 of the first embodiment. Referring now to FIGS. 5 and 6, the second embodiment of this invention is shown and is referred to generally by the numeral 110. As in the first embodiment, a wall structure 112 is shown having an inner wythe or backup wall 114 of masonry blocks 116 and an outer wythe or a veneer 118 of facing bricks 120. Between the inner wythe 114 and the outer wythe 118, a cavity 122 is formed.

The cavity 122 is insulated with strips of insulation 123 attached to the exterior surface 124 of the inner wythe 114 and having seams .125 between adjacent strips coplanar with adjacent bed joints 126 and 128. The cavity 122 is as specified by architectural design and is normally in the 2-to-4-inch range. Successive bed joints 126 and 128 are formed between courses of blocks 116 and the joints are substantially planar and horizontally disposed. Also, successive bed joints 130 and 132 are formed between courses of bricks 120 and the joints are substantially planar and horizontally disposed. Selected bed joint 126 and bed joint 130 are constructed to be interconnected utilizing the construct hereof; however, the joints 126 and 130 are unaligned.

For purposes of discussion, the exterior surface 124 of the interior wythe 114 contains a horizontal line or x-axis 134 and an intersecting vertical line or y-axis 136. A horizontal line or z-axis 138, normal to the xy-plane, also passes through the coordinate origin formed by the intersecting x- and y-axes.

The wall anchor 140 is shown in FIG. 6 as having an insulation-spanning portion 142 for interconnection with veneer tie 144 and further is shown as being emplaced on a course of blocks 116 in preparation for embedment in the mortar of bed joint 126. In this embodiment, a truss-type wall reinforcement 146 is constructed of a wire formative with two parallel continuous straight side wire members 148 and 150 spaced so as, upon installation, to each be centered along the outer walls of the masonry blocks 116. An intermediate wire body 152 is interposed therebetween and connect wire members 148 and 150 separating and connecting side wires 148 and 150 reinforcement 146.

At intervals along the truss-type reinforcement 146, spaced pairs of transverse wire members 154 are attached by electric resistance welding to side wire 148. These pairs of wire members 154 extend into the cavity 122. Upon receiving the interconnecting portion of veneer anchor 144, the spacing between wire members 154 limits the x-axis movement of the construct. Each transverse wire member 154 has at the end opposite the attachment end an eye wire portion 158 formed contiguous therewith.

Upon installation, the eyes 160 of eye wire portions 158 are constructed to be within a substantially horizontal plane normal to exterior surface 124. The eyes 160 are horizontally aligned to accept the pintles of a veneer anchor 144 threaded therethrough. The eyes 160 are slightly larger than the diameter of the pintles, which dimensional relationships minimize the movement of the construct in an xz-plane. For ensuring engagement, the pintles of veneer tie member 144 are constructed in a variety of lengths.

The low-profile veneer tie or wire formative anchor 144 is, when viewed from a top or bottom elevation, generally U-shaped. The low-profile wall tie 144 is dimensioned to be accommodated by a pair of eye wire portions 158 described, supra. The veneer anchor 144 has two rear leg portions or pintles 162 and 164, two substantially parallel side leg portions 166 and 168, which are substantially at right angles and attached to the rear leg portions 162 and 164, respectively, and a front leg portion 170. An insertion portion 172 of veneer anchor 144 is compressively reduced to a vertical height 174 and, upon installation, extends beyond the cavity 122 into bed joint 130, which portion includes front leg portion 170 and part of side leg portions 166 and 168. The longitudinal axes of side leg portions. 166 and 168 and the longitudinal axis of the front leg portion 170 are substantially coplanar.

In the second embodiment, the above-described arrangement of wire formatives is readily adaptable for high-strength applications. This is accomplished by replacing standard 9-gage (0.148-inch diameter) wall reinforcement wire with 3/16-inch (0.187-inch diameter) wire and, if additional strength is required, using a 0.250-inch wire is used to form the veneer anchor 144. In contradistinction to the first embodiment the insertion ends of wall anchor 140 is not compressively reduced in height. In this regard, veneer anchor 140 is reduced in height by 79%, to a height of 0.148-inch. Also and similar to the first embodiment, the successive insulation strips 123 when in an abutting relationship the one with the other are sufficiently resilient to seal at seam 125 without air leakage therebetween. The insulation-spanning portions 142 of wall anchor 140 are not flattened.

Upon compressing the insertion end of wall anchor 144, a corrugated pattern is optionally impressed thereon. The ridges and valleys of the corrugations 176 are shown in FIGS. 5 and 6 and are impressed so that, upon installation, the corrugations 176 are parallel to the x-axis 134.

The insertion portion 172 of veneer tie 144 is considerably compressed and, while maintaining the same mass of material per linear unit as the adjacent wire formative, the vertical height 174 is reduced. The vertical height 174 of insertion portion 172 is reduced so that, upon installation, mortar of bed joint 130 flows around the insertion portion 172. Upon compression, a pattern or corrugation 176 is impressed on either or both of the upper and lower surfaces of insertion portion 172. When the mortar of bed joint 130 flows around the insertion portion, the mortar flows into the valleys of the corrugations 176. The corrugations enhance the mounting strength of the veneer anchor 144 and resist force vectors along the z-axis 138. With veneer anchor 144 compressed as described, the veneer anchor retains substantially all the tensile strength as prior to compression.

The description which follows is of a third embodiment of the combined wall anchor and wall reinforcement device of this invention, which device is suitable for seismic applications. For ease of comprehension, where similar parts are used reference designators "200" units higher are employed. Thus, the wall anchor 240 of the third embodiment is analogous to the wall anchor 40 of the first embodiment. The veneer anchor of this embodiment is adapted from that shown in U.S. Pat. No. 5,454,200 to R. P. Hohmann.

Figure 7:
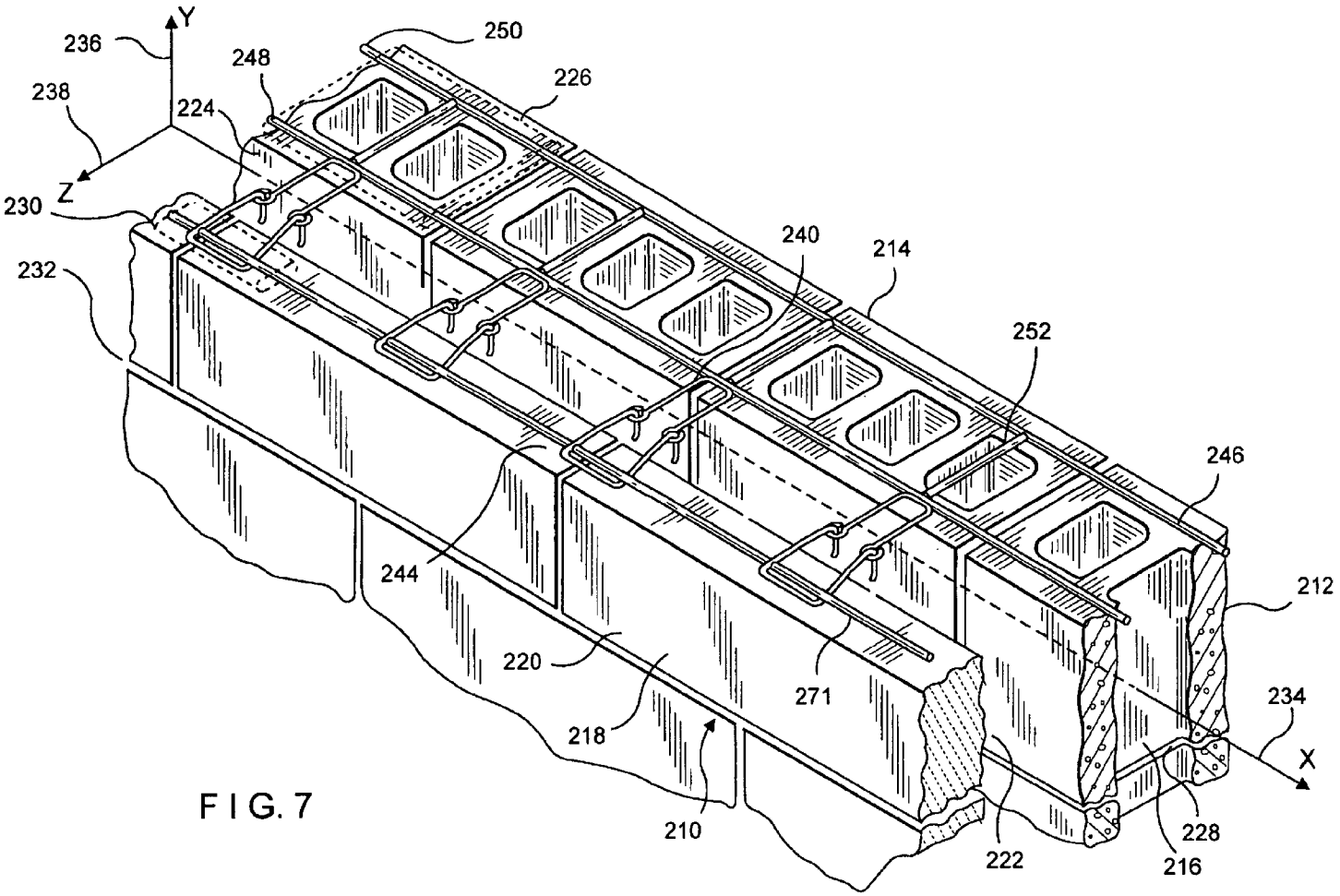
FIG. 7 is a perspective view of a third embodiment of this invention showing an anchor and reinforcement device for a masonry wall and is similar to FIG. 1, but is suitable for use in a seismic zone and shows a veneer anchor swaged to accept a continuous reinforcing wire for the stone veneer.
Figure 8:
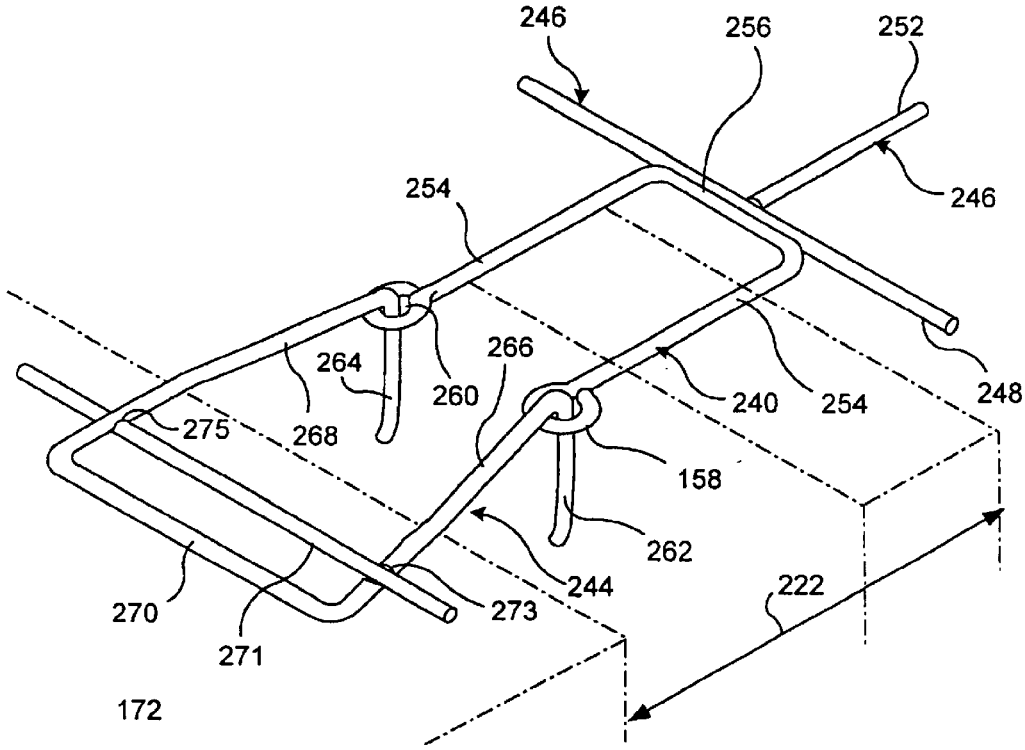
FIG. 8 is a partial perspective view of FIG. 7 showing details of a portion of the ladder-type reinforcement, the side-welded wall anchor, veneer anchor, and the veneer reinforcement.

Referring now to FIGS. 7 and 8, the third embodiment of a combined wall anchor and wall reinforcement device of this invention is shown and is referred to generally by the numeral 210. In this embodiment, a wall structure 212 is shown having an backup wall 214 of masonry blocks 216 and a facing wall or veneer 218 of facing stone 220. Between the backup wall 214 and the facing wall 218, a cavity 222 is formed, which cavity 222 extends outwardly from surface 224 of backup wall 214.

In the third embodiment, successive bed joints 226 and 228 are formed between courses of blocks 216 and the joints are substantially planar and horizontally disposed. Also, successive bed joints 230 and 232 are formed between courses of facing stone 220 and the joints are substantially planar and horizontally disposed. For each structure, the bed joints 226, 228, 230 and 232 are specified as to the height or thickness of the mortar layer and such thickness specification is rigorously adhered to so as to provide the uniformity inherent in quality construction. Selected bed joint 226 and bed joint 230 are constructed to align, that is to be substantially coplanar, the one-with the other.

For purposes of discussion, the exterior surface 224 of the backup wall 214 contains a horizontal line or x-axis 234 and an intersecting vertical line or y-axis 236. A horizontal line or z-axis 238, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 210 includes a wall anchor 240 constructed for embedment in bed joint 226, which, in turn, includes a cavity-spanning portion 242. Further, the device 210 includes a low-profile, wire formative veneer tie or anchor 244 for embedment in bed joint 230. In order to meet seismic requirements, a veneer reinforcement, described infra., is included in anchoring system hereof.

The wall anchor 240 is shown in FIG. 7 as being emplaced on a course of blocks 216 in preparation for embedment in the mortar of bed joint 226. In the best mode of practicing this embodiment, a ladder-type wall reinforcement wire portion 246 is constructed of a wire formative with two parallel continuous straight wire members 248 and 250 spaced so as, upon installation, to each be centered along the outer walls of the masonry blocks 216. An intermediate wire bodies or cross rods 252 are interposed therebetween and connect wire members 248 and 250 forming rung-like portions of the ladder structure 246.

At intervals along the wall reinforcement 246, spaced pairs of transverse wire members 254 are attached thereto and are attached to each other by a rear leg 256 therebetween. These pairs of wire members 254 extend into cavity 222 to veneer anchor 244. As will become clear by the description which follows, the spacing between the transverse wire member 254 is constructed to limit the x-axis movement of the construct. Each transverse wire member 254 has at the end opposite the attachment end an eye wire portion 258 formed contiguous therewith.

Upon installation, the eye 260 of eye wire portion 258 is constructed to be within a substantially horizontal plane normal to exterior surface 224. The eye 260 is dimensioned to accept a pintle of the veneer anchor therethrough and has a slightly larger diameter than that of the anchor. This relationship minimizes the movement of the construct in an xy-plane. For positive engagement, the eye 260 of eye wire portion. 258 is sealed forming a closed loop.

The veneer anchor 244 is, when viewed from a top or bottom elevation, generally U-shaped and is dimensioned to be accommodated by the pair of eye wires 258 previously described. The veneer anchor 244 has two rear leg portions or pintles 262 and 264, two parallel side leg portions 266 and 268, and a front leg portion 270, which have been compressively reduced in height. The front leg portion 270 accommodates veneer reinforcing wire member 271 which is threaded through swaged indentations 273 and 275.

As shown in FIG. 8, swaged indentation 273 is formed in the upper surface of side leg 266 so that, upon installation, the reinforcing wire 271 placed-therein is embedded in bed joint 230. Also as shown in FIG. 8, swaged indentation 275 is formed in the lower surface of side leg 268 so that, upon installation, the reinforcing wire 271 placed therein is embedded in bed joint 230. Although the swaged indentations 273 and 275 are described as shown, the function of the veneer anchor 244 would be the same if the indentations were reversed. The longitudinal axes of leg portions 266, 268 and 270 are substantially coplanar. The pintles 262 and 264 are dimensioned to function cooperatively with the eyes 260 of eye wire portions 258 and thereby limits the movement of the construct in an xy-plane.

In this embodiment, indentations 273 and 275 are swaged into leg portions 266 and 268, respectively, which indentations are dimensioned to accommodate and cradle veneer reinforcing wire 271. With the veneer reinforcing wire 271 installed threadingly in veneer anchor 244 as described, the anchoring system meets building code requirements for seismic construction and the wall structure acquires the testing conditions therefor.

The above-described arrangement of wire formatives has been strengthened in several ways. First, in place of the standard 9-gage (0.148-inch diameter) wall reinforcement wire, a 3/16-inch (0.187-inch diameter) wire is used throughout. Here, wall reinforcement 246, wall anchor 240, the veneer tie 244, and veneer reinforcing wire 271 are all formed from 0.187-inch diameter wire. The insertion end 272 of veneer tie 244 is reduced in height to 75% of original height to a height of 0.140-inch with the indentation 278 to a height of 0.110-inch. This enables the veneer reinforcing wire 271 to interlock with the veneer tie within the 0.300-inch tolerance. Although in this example compressive sizing is limited, the embodiment demonstrates the flexibility provided to architectural engineers by selectively compressing either or both the inner and outer wythe anchoring components.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A side-welded anchor and reinforcement device for use in a wall formed from a backup wall and a facing wall in a spaced apart relationship having a cavity therebetween, said backup wall being formed from a plurality of successive courses of masonry blocks with a bed joint of predetermined height between each two adjacent courses and, further, having a vertical surface forming one side of said cavity, said bed joint and said vertical surface defining an envelope, said side-welded anchor and reinforcement device comprising, in combination:

a wall reinforcement adapted for disposition upon one of said courses of masonry blocks and for embedment in said bed joint of said backup wall, said wall reinforcement being a wire formative, in turn, comprising;

a pair of side wires disposed parallel to one another;

one or more intermediate wires attached to the interior sides of said side wires maintaining the parallelism thereof in a truss or ladder configuration;

at least one wall anchor fusibly attached at one end thereof to said wall reinforcement at the side opposite said interior side of said intermediate wire attachment, and, upon installation, extending into said envelope, said wall anchor comprising, in turn:

one or more leg portions extending into said cavity; and, a free end contiguous therewith, said free end disposed in said cavity and adapted to interengage a veneer anchor for mounting in said bed joint of said facing wall.

2. A side-welded anchor and reinforcement device as described in claim 1, wherein said wall anchor is a wire formative having two legs extending into said cavity, said legs connected to one another by a rear leg fusibly attached along the length thereof to said exterior side of said side wire.

3. A side-welded anchor and reinforcement device as described in claim 2, wherein said free end further comprises a veneer anchor receptor of vertically disposed eye wires.

4. A side-welded anchor and reinforcement device as described in claim 2, wherein said free end further comprises a veneer anchor receptor of horizontally disposed eye wires.

5. A side-welded anchor and reinforcement device as described in claim 2, wherein said backup wall further has an insulative layer mounted on the said vertical surface in said cavity, said insulative layer being spanned by extended legs of said wall anchor.

6. A side-welded anchor and reinforcement device as described in claim 5, wherein said extended leg portions are compressively reduced in height up to 75% of the original height thereof, said insulative layer further comprises a plurality of insulative strips mounted sealingly one against the other having a seam between adjacent ones of said strips, said seams being substantially coplanar with corresponding said bed joint of said backup wall and wherein said extended leg of said wall anchor portion is adapted, upon said wall anchor being mounted in said bed joint of said backup wall, to extend across said insulative layer at said seam between adjacent ones of said insulative strips and to have said insulative strips sealingly surround said extended leg of said wall anchor.

7. A side-welded anchoring system for use in a wall formed from a backup wall and a facing wall in a spaced apart relationship having a cavity therebetween, said backup wall being formed from a plurality of successive courses of masonry blocks with a bed joint of predetermined height between each two adjacent courses and, further, having a vertical surface forming one side of said cavity, said bed joint and said vertical surface defining an envelope, said side-welded anchoring system comprising, in combination:

a wall reinforcement adapted for disposition upon one of said courses of masonry blocks and for embedment in said bed joint of said backup wall, said wall reinforcement being a wire formative, in turn, comprising;

a pair of side wires disposed parallel to one another;

one or more intermediate wires attached to the interior sides of said side wires maintaining the parallelism thereof in a truss or ladder configuration;

at least one wall anchor fusibly attached at one end thereof to said wall reinforcement at the side opposite said interior side of said intermediate wire attachment, and, upon installation, extending into said envelope, said wall anchor comprising, in turn:

one or more leg portions extending into said cavity; and, a free end contiguous therewith, said-free end disposed in said cavity and including a veneer anchor receptor for interengaging a veneer anchor; and, a veneer anchor for embedment in said facing wall.

8. A side-welded anchoring system as described in claim 7, wherein said facing wall is formed from a plurality of successive courses of brick with a bed joint of predeter mined height between each two adjacent courses, said side-welded anchoring system further comprising a veneer anchor having an interlocking end and an insertion end, said interlocking end adapted to engage said veneer anchor receptor of said wall anchor and said insertion end adapted to be disposed within said bed joint of said facing wall.

9. A side-welded anchoring system as described in claim 8, wherein said wall anchor further comprises:

veneer anchor receptor at the end opposite said attachment end, said veneer anchor receptor, upon installation of said side-welded anchoring system, disposed in said cavity.

10. A side-welded anchoring system as described in claim 9, wherein said facing wall is formed from a plurality of successive courses of bricks with a bed joint of predetermined height between each two adjacent courses, said side-welded anchoring system further comprising:

a veneer anchor for interengagement with said veneer anchor receptor of said wall anchor, said veneer anchor, upon installation, adapted for insertion in said bed joint of said outer wythe.

11. A side-welded anchoring system as described in claim 10 wherein said veneer anchor receptor has two vertically disposed loops and said veneer anchor is a box tie having an opening for threadingly engaging said wall anchor, said opening, upon installation, adapted for insertion in said bed joint of said outer wythe.

12. A side-welded anchoring system as described in claim 11 wherein said opening of said veneer anchor is between two parallel front legs, said anchoring system further comprising:

a veneer reinforcement disposed between said front legs;

whereby said anchoring system meets the requirements of seismic specifications.

13. A side-welded anchoring system as described in claim 10, wherein said veneer anchor receptor has two horizontally disposed eyes and said veneer anchor has two pintle legs interengaging therewith in a closely fitting relationship and thereby limiting movement in a horizontal plane.

14. A veneer anchor for use with a cavity wall formed from a backup wall and a facing wall in a spaced apart relationship having a cavity therebetween, and a wall anchoring system having a wall anchor and a wall reinforcement device for said backup wall, said veneer anchor comprising:

a U-shaped wire formative having, upon installation, an insertion portion and a cavity-disposed portion;

a pair of pintle legs contiguous with the ends of said cavity-disposed portion and attached thereto at approximately 90 degrees, said pintle legs interengageable with said wall anchor; and, a pair of swaged indentations in said insertion portion of said U-shaped wire formative, one in each leg thereof and adapted to encapture a veneer reinforcement therewithin;

whereby said veneer anchor meets the requirements of seismic specifications.

15. A veneer anchor as described in claim 14 wherein said swaged indentations are on opposite sides of said wire formative and the veneer reinforcement is interweavable therethrough.

* * * * *